US006994171B2

(12) United States Patent
Orr et al.

(10) Patent No.: US 6,994,171 B2
(45) Date of Patent: Feb. 7, 2006

(54) TWO SECTION MAST WITH SELF-ALIGNING CONNECTIONS

(75) Inventors: Alan Orr, Tulsa, OK (US); Mark Trevithick, Houston, TX (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 10/766,624

(22) Filed: Jan. 28, 2004

(65) Prior Publication Data

US 2005/0161240 A1 Jul. 28, 2005

(51) Int. Cl.
*E21B 7/02* (2006.01)

(52) U.S. Cl. ..... 173/28; 173/1; 173/24

(58) Field of Classification Search ..... 175/85, 175/161, 162; 173/24, 28, 184, 1; 166/379; 52/123.1

See application file for complete search history.

(56) References Cited

U.S. PATENT DOCUMENTS

| | | | | | |
|---|---|---|---|---|---|
| 2,857,993 | A | | 10/1958 | Terrell | 189/11 |
| 4,021,978 | A | | 5/1977 | Busse et al. | 52/118 |
| 4,134,237 | A | * | 1/1979 | Armstrong | 52/118 |
| 4,371,041 | A | | 2/1983 | Becker et al. | 173/28 |
| 4,489,526 | A | * | 12/1984 | Cummins | 52/125.6 |
| 4,753,300 | A | | 6/1988 | Shaw et al. | 173/164 |
| 4,821,814 | A | | 4/1989 | Willis et al. | 173/164 |
| 4,821,816 | A | * | 4/1989 | Willis | 175/57 |
| 4,831,795 | A | * | 5/1989 | Sorokan | 52/120 |
| 4,885,893 | A | * | 12/1989 | Wasterval et al. | 52/745.18 |
| 4,899,832 | A | | 2/1990 | Bierscheid, Jr. | 173/23 |
| 5,107,940 | A | | 4/1992 | Berry | 175/85 |
| 5,381,867 | A | | 1/1995 | Berry | 175/85 |
| 5,755,296 | A | | 5/1998 | Richardson et al. | 175/162 |
| 5,794,723 | A | | 8/1998 | Caneer, Jr. et al. | 175/85 |
| 6,024,181 | A | | 2/2000 | Richardson et al. | 175/162 |
| 6,257,349 | B1 | | 7/2001 | Bardwell | 173/28 |
| 6,594,960 | B2 | * | 7/2003 | Brittain et al. | 52/117 |
| 6,860,337 | B1 | * | 3/2005 | Orr et al. | 173/28 |
| 2003/0051915 | A1 | | 3/2003 | Brittain et al. | 175/52 |
| 2004/0129417 | A1 | * | 7/2004 | Nelson et al. | 166/177.4 |
| 2004/0211598 | A1 | * | 10/2004 | Palidis | 175/162 |
| 2004/0231857 | A1 | * | 11/2004 | Kainer et al. | 166/379 |

* cited by examiner

*Primary Examiner*—Louis K. Huynh
*Assistant Examiner*—Gloria R. Weeks
(74) *Attorney, Agent, or Firm*—Head, Johnson & Kachigian

(57) ABSTRACT

A method of self-aligning connections for a two section mast. The method includes the steps of transporting the elongated bottom mast section to a guide frame adjacent to a well site, the bottom mast section having a pair of front legs and a pair of rear legs. An elongated top mast section is transported to the well site, the top mast section having a pair of front legs and a pair of rear legs. The legs of the bottom mast section are positioned slightly below a level of the legs of the top mast section. Thereafter, the bottom mast section is raised slightly to order to engage the top mast section while simultaneously aligning the mast sections together. The sections are thereafter pinned together.

14 Claims, 7 Drawing Sheets

TWO SECTION MAST WITH SELF-ALIGNING CONNECTIONS

BACKGROUND OF THE INVENTION

1. Field of the Invention.

The present invention relates to a method and apparatus for providing self-aligning connections for a two section mast for a drilling rig.

2. Prior Art.

In various oil and gas operations, well drilling rigs are utilized for subterranean drilling. A mast or derrick of a drilling rig are well known devices used in oil and gas and other drilling operations. The drilling rig will often include an upstanding mast connected to the floor of the drilling rig. The mast may extend vertically 40 to 50 meters or more and be composed of structural steel framework.

It is often desirable to move a large drilling rig, including all of its equipment, from one well bore to another. In the past, in order to move a large drilling rig, it has been necessary to disassemble or "rig down" the drilling structure. The rig down process requires a great many steps including disconnecting all ancillary services, laying down of the mast from a vertical to a horizontal position, disassembling the mast, moving the drilling structure components to an alternate well bore, and then reassembling the entire drill structure in a "rig up" operation.

The drilling mast may include a back face joining a pair of sides and an open front face. The mast may be divided into a top mast section and a bottom mast section, with each mast section having front legs and rear legs. Each mast section may be brought to a well site on a vehicle and then the front legs and the rear legs of the sections are attached.

Once the sections of the mast are connected together while in a horizontal position, the mast would be moved radially from a horizontal to a vertical position.

When connecting the sections of mast together, it is necessary to align the connecting ends of the legs and insert pins through aligned openings to hold the sections together. This typically would require repeated movements of the sections until they were positioned in proper alignment. Even with repeated movements of the mast sections, there would be required extensive use of sledge hammers or other equipment to drive the pins in.

Also in the past, the concept of self aligning connections in which structural components are maneuvered into final position by guiding elements has been utilized and is common within many industries. In fact, at least one prior drilling mast utilizes a self aligning type connection to join a fixed lower section to an upper section that is lifted into position by a crane.

However, the present invention is unique in the configuration and geometry of the structural/guiding elements and in the process by which an upper mast section is positioned in a generally horizontal plane by a tractor trailer with dolly and then aligned and joined by the connection to a fixed lower mast section supported at one end by hydraulic mast stands.

Accordingly, it would be advantageous to provide a two section mast with self-aligning connections which reduces the number of truck loads required for moving the sections and which improves the overall efficiency of the rig up and rig down process.

It would also be advantageous to provide a two section mast with self-aligning connections which eliminates complicated and cumbersome systems required in telescopic, folding, or collapsible mast designs.

It would also be advantageous to provide a two section mast with self-aligning connections which reduces the time required for mast assembly prior to erection by repeatable and precise relative positioning of the mast sections with respect to each other.

It would be advantageous to provide a two section mast with self-aligning connections which facilitates controlled pin installation rather than sledge hammer driven alignment.

It would be advantageous to provide a two section mast with self-aligning connections which reduce or eliminate the use of sledge hammers during mast assembly and disassembly.

SUMMARY OF THE INVENTION

The present invention is directed to a two section mast with self-aligning connections. The two section mast includes an elongated bottom mast section that may be transported and brought to a mast stand at a drilling rig by a vehicle such as a tractor trailer and dolly in a generally horizontal orientation. The bottom mast section is oriented so that the dolly is on a guide frame and the lower most end of the bottom mast section is adjacent the drilling rig.

The bottom mast section includes a pair of front legs and a pair of parallel and opposed rear legs. Hydraulic cylinders are raised so that the rear legs of the bottom mast section are engaged and the bottom mast section is raised from the tractor trailer and supported by the hydraulic cylinders and the dolly. Once this is accomplished, the unattached tractor trailer is free to move away.

An elongated top mast section is thereafter brought to the well site by a vehicle such as a tractor trailer and dolly with the top mast section transported in a generally horizontal position.

The top mast section includes a pair of front legs and a pair of parallel and opposed rear legs. The bottom mast section is positioned so that the front legs of the bottom mast section are aligned but slightly lower than the front legs of the top mast section. Likewise, the rear legs of the bottom mast section are aligned but slightly lower than the level of the top mast rear legs.

The pair of bottom mast front legs each terminate in an open alignment jaw having a pair of opposed hooks. The alignment jaws with pairs of hooks will engage the pair of top mast front legs which each terminate in a pair of protruding circular plates. The protruding circular plates align with and are received in the jaw of the bottom mast front legs and in particular in the opposed hooks. The circular plates and the jaws each include a central opening to receive a pin or other fastener therethrough.

Likewise, the pair of bottom mast rear legs each terminate in an open jaw having a pair of protruding opposed circular plates. The bottom mast rear legs mate with a pair of protruding arms, each arm having shoulders extending from the top mast rear legs.

The hydraulic cylinders engage and raise the bottom mast so that the hooks on the front legs engage and receive the protruding circular plates of the front legs top mast section. As the bottom mast continues to be raised, the rear legs of the bottom mast likewise will come into alignment with the rear legs of the bottom mast until the protruding opposed circular plates of the bottom mast rear legs come to rest against the shoulders of the protruding arms of the top mast rear legs.

DETAILED DESCRIPTION OF THE PREFERRED EMBODIMENTS

Figure 1:
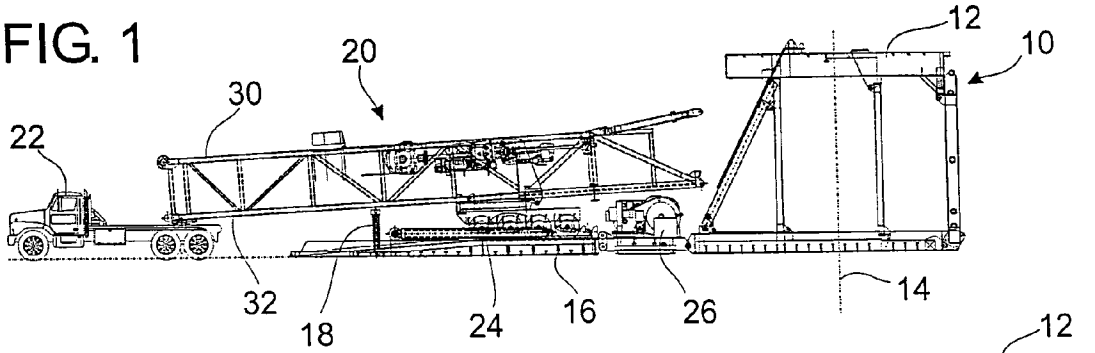
FIGS. 1 through 5 illustrate the sequential operation of a two section mast for a drilling rig with self-aligning connections between a top mast section and a bottom mast section.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Referring to the drawings in detail, FIGS. 1 through 5 illustrate a sequence to assemble a two section mast for a drilling rig 10 during the rig up process which incorporates the method of self-aligning connections of the present invention. The drilling rig 10 may include a substructure 12 on which the two section mast is raised and installed as well as a draw works 26. The substructure 12 is located over a well bore, depicted by dashed line 14. The component parts of the drilling rig are brought to the well bore at a well site and then assembled for use, all as are known in the art.

The drilling rig 10 may also include a guide frame 16 including mast stands 18. In the present embodiment, a pair of hydraulic cylinders connected to the hydraulic utilities (not shown) of the drilling rig are utilized to activate the mast stands, although it will be appreciated that other arrangements are possible.

The two section mast includes an elongated bottom mast section 20. The bottom mast section 20 may be transported and brought to the mast stand 16 at the drilling rig 10 by a vehicle such as a tractor trailer 22 and dolly 24. The bottom mast section 20 is transported in a generally horizontal position. Once at the drilling rig site, the tractor trailer 22 with bottom mast section 20 may be backed up and oriented so that the dolly 24 is on a ramp of the guide frame 16 and the lower most end of the bottom mast section 20 is adjacent the drilling rig substructure 12.

The bottom mast section 20 includes a pair of front legs 30 and a pair of parallel and opposed rear legs 32 (one front leg and one rear leg visible in FIG. 1). Once the bottom mast section 20 has been brought into place on the guide frame 16, it is adjacent the substructure of the drilling rig with the lower most end closest to the substructure 12. The mast stands 18 are then raised so that the rear legs 32 of the bottom mast section are engaged. Thereafter, the bottom mast section is raised from the tractor trailer 22 and is supported by the mast stands 18 and by the dolly 24. Once this is accomplished, the unattached tractor trailer 22 is free to move away.

Figure 2:
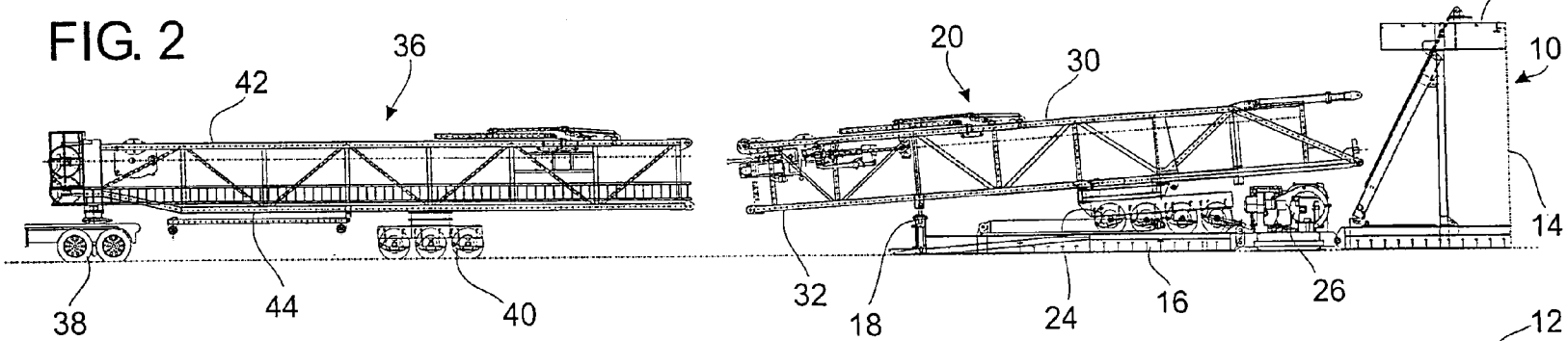

As best seen in FIG. 2, an elongated top mast section 36 is thereafter brought to the well site by a vehicle such as a tractor trailer 38 and a dolly 40. The top mast section is transported in a generally horizontal position. The tractor trailer 38 with top mast section 36 may be backed up and oriented so that it is aligned with the bottom mast section 20. The lower end of the top mast section 36 is adjacent the upper end of the bottom mast section 20.

Figure 3:
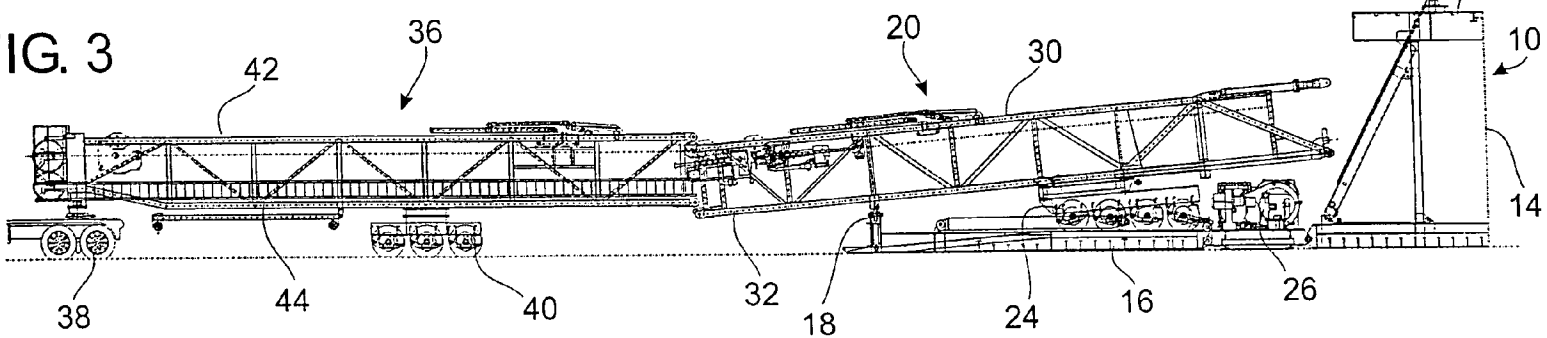

The top mast section 36 includes a pair of front legs 42 and a pair of parallel and opposed rear legs 44 (one front leg and one rear leg visible in FIG. 2). As best seen in FIG. 3, the bottom mast section 20 is positioned so that the front legs 30 of the bottom mast section are aligned but slightly lower than the front legs 42 of the top mast section. Likewise, the rear legs 32 of the bottom mast section are aligned but slightly lower than a level of the top mast rear legs 44.

Thereafter, the mast stands 18 are utilized to engage the rear legs 32 and raise the bottom mast section 20. As will be described herein in combination with the self-aligning connections of the present invention, this will accurately align the bottom mast front legs 30 with the top mast front legs 42 and accurately align the bottom mast rear legs 32 with the top mast rear legs 44. Stated in other words, the front legs 30 of the bottom mast section 20 are in planar alignment with the front legs 42 of the top mast section 36 and the rear legs 32 of the bottom mast section 20 are in planar alignment with the rear legs 44 of the top mast section 36.

Figure 4:
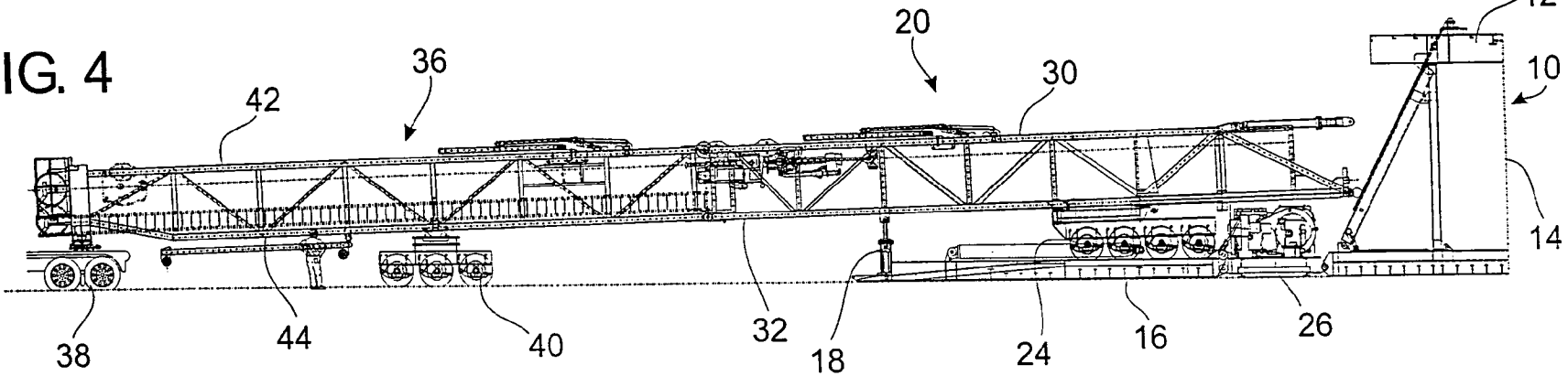
Figure 5:
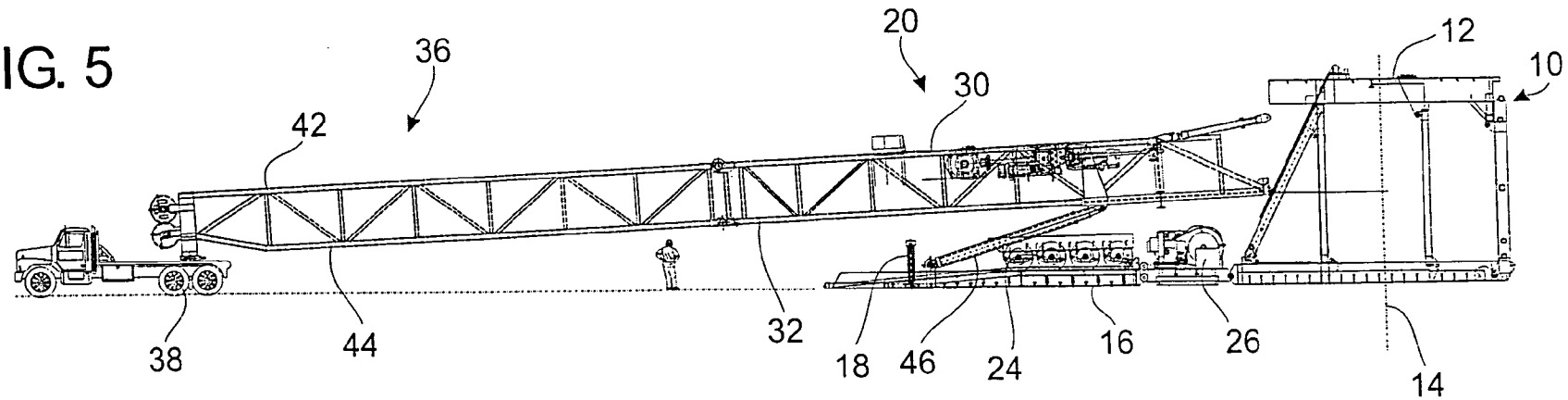
Figure 6:
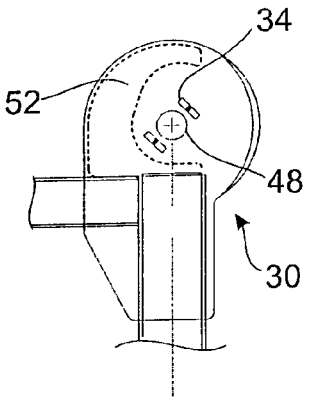
FIGS. 6, 7, 8 and 9 illustrate a front leg of the bottom mast of the present invention.
Figure 7:
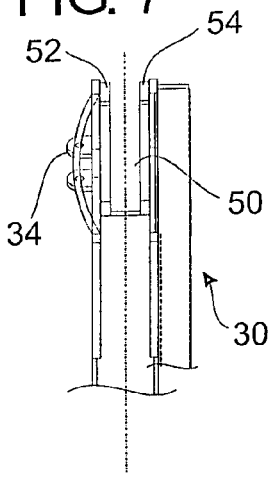
Figure 8:
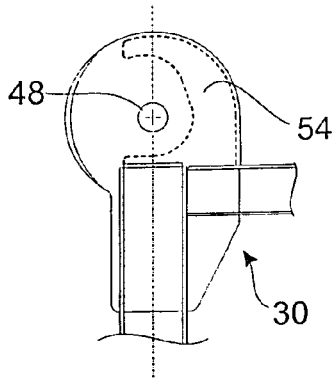
Figure 9:
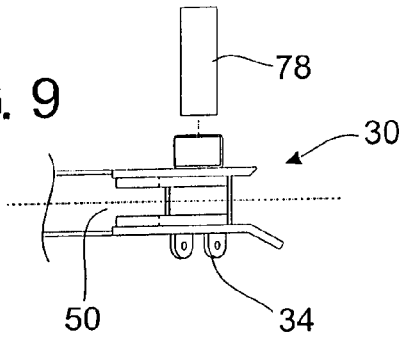

Thereafter, as shown in FIG. 4 with the two mast sections aligned, pins or other fastening mechanisms may be used to rigidly attach the bottom mast section 20 to the top mast section 36. Finally, the combined top mast and bottom mast are raised from the generally horizontal orientation for transportation to a vertical orientation (not shown). The beginning stages of raising the bottom mast and top mast sections are illustrated in FIG. 5 through use of a hydraulic cylinder or hydraulic cylinders 46.

It will be appreciated that the process is performed in reverse sequence during the rig down process.

As best seen in FIGS. 6, 7, 8 and 9, the pair of bottom mast front legs 30 each terminate in an open alignment jaw 50 having a pair of opposed hooks 52 and 54. Each aligned jaw 50 includes a central opening 48 to receive a pin or other fastener therethrough. Tabs 34 may be provided to receive a transverse retainer fastener to hold the pin in place. As will be seen, the alignment jaws 50 with pairs of hooks engage the pair of top mast front legs 30.

Figure 10:
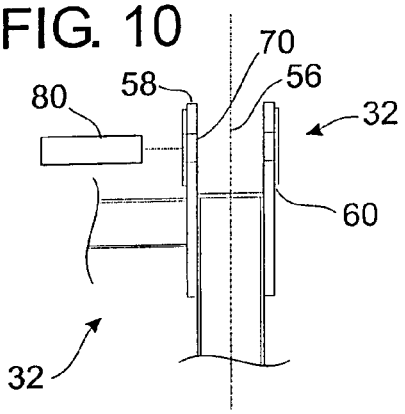
FIGS. 10 and 11 illustrate a rear leg of the bottom mast of the present invention.
Figure 11:
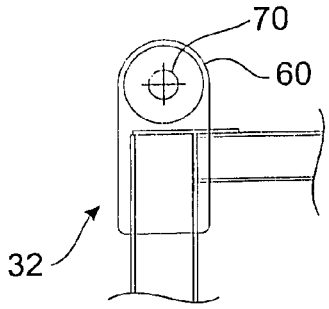

Likewise, as best seen in FIGS. 10 and 11, the pair of bottom mast rear legs 32 each terminate in an open jaw 56 having a pair of protruding opposed semi-circular plates 58 and 60. Each pair of opposed circular plates 58 and 60 includes a central opening 70 to receive a pin or other fastener therethrough.

The bottom mast rear legs 32 mate with a protruding arm having shoulders on each of the top mast rear legs 44.

Figure 12:
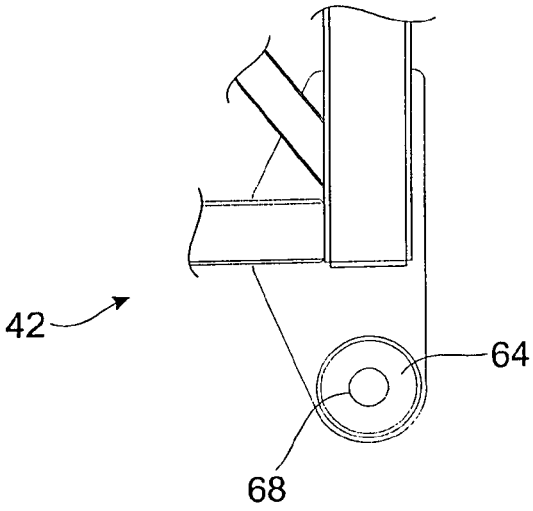
FIGS. 12 and 13 illustrate a front leg of the top mast of the present invention.
Figure 13:
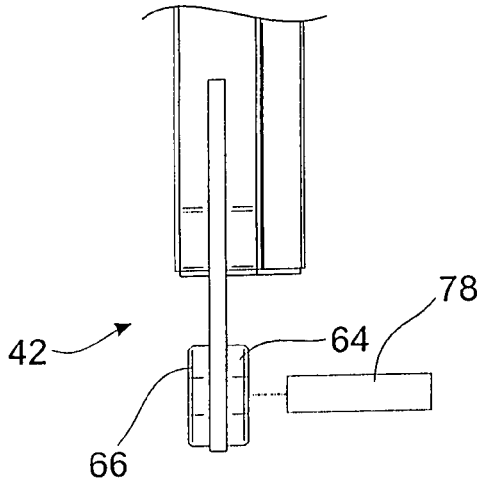

As best seen in FIGS. 12 and 13, the pair of top mast front legs 42 each terminate in a pair of arms, each having protruding circular plates 64 and 66. The protruding circular plates 64 and 66 align with and are received in the jaw of bottom mast front legs 30 and, in particular, in the opposed hooks 52 and 54. The protruding circular plates 64 and 66 each have a central opening 68 therethrough in which a pin 78 or other fastener is received once the top mast front legs and the bottom mast front legs are aligned and in place.

Figure 14:
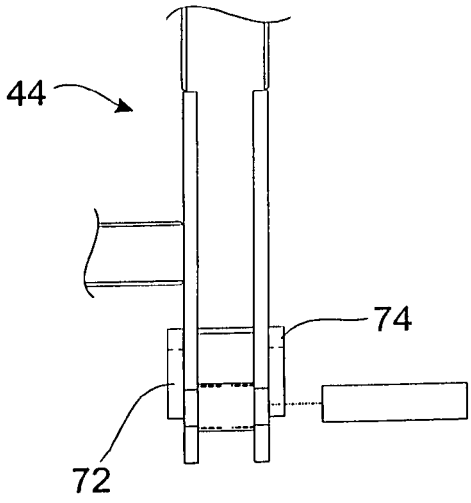
FIGS. 14 and 15 illustrate a rear leg of the top mast of the present invention.
Figure 15:
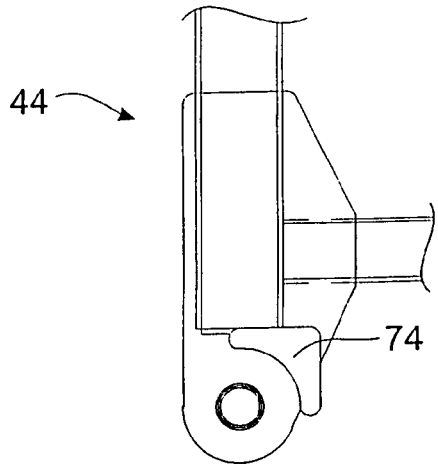

As best seen in FIGS. 14 and 15, the top mast rear legs 44 each terminates in a protruding arm having a pair of shoulders 72 and 74. The arm includes a central opening 76 to receive the pin 80 or other fastener therethrough.

Figure 16:
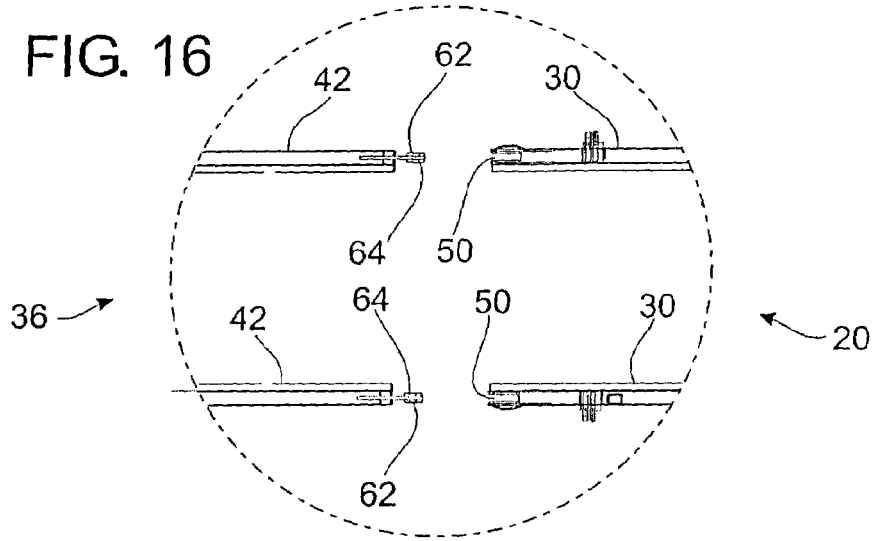
FIGS. 16 through 24 illustrate the sequential operation of the self-aligning connection of the bottom mast with the top mast of the present invention.
Figure 17:
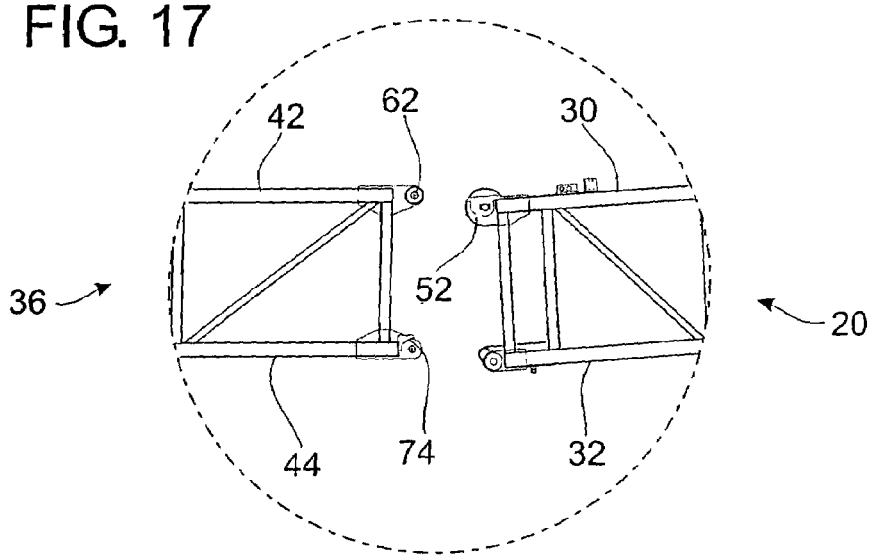
Figure 18:
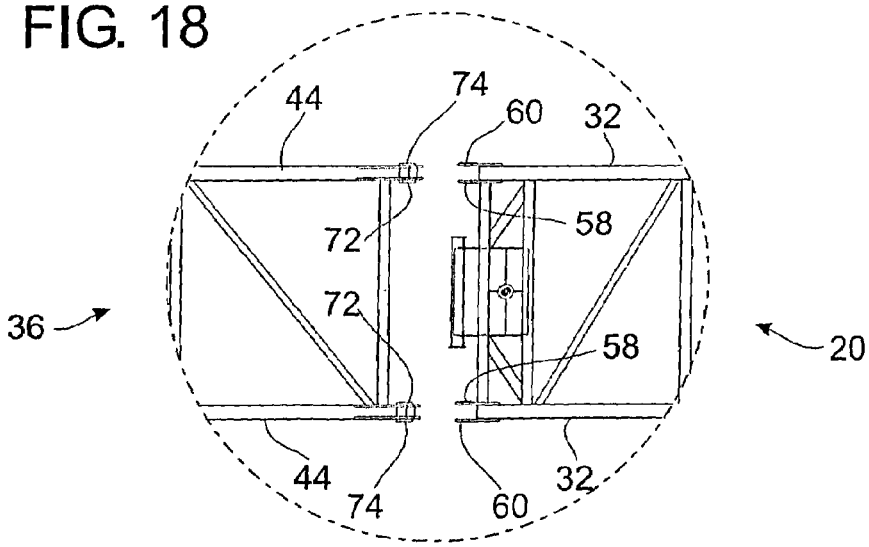

FIGS. 16 through 24 also illustrate the sequential operation of the present invention. FIG. 16 shows a top view, FIG. 17 shows a side view and FIG. 18 shows a bottom view of the bottom mast section 20 juxtaposed with the top mast section 30. The views in FIGS. 16, 17 and 18 generally correspond in sequence to the drawing in FIG. 2.

The lower most end of the upper mast 36 is brought adjacent to the upper most end of the bottom mast section 20. The bottom mast section is aligned but, as seen in FIG. 17, slightly lower than the level of the top mast.

Figure 19:
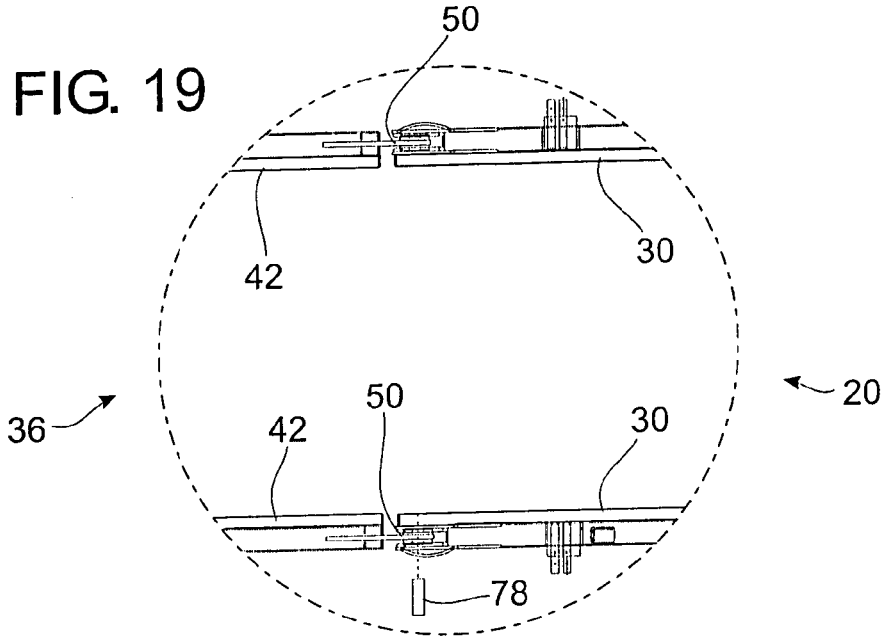
Figure 20:
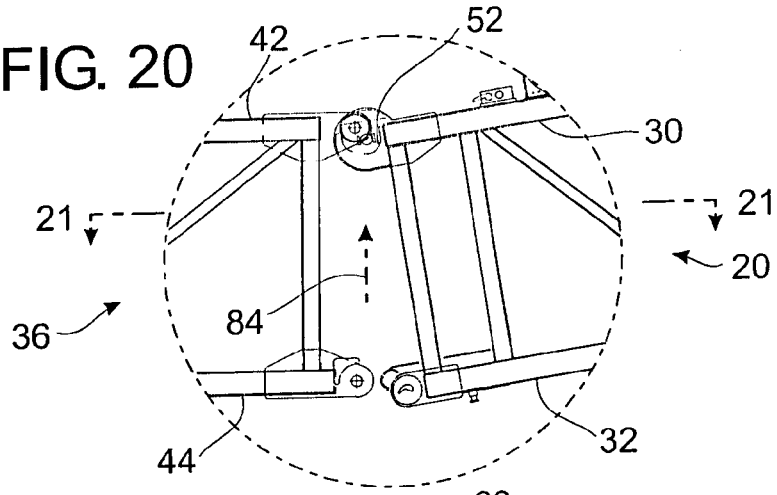
Figure 21:
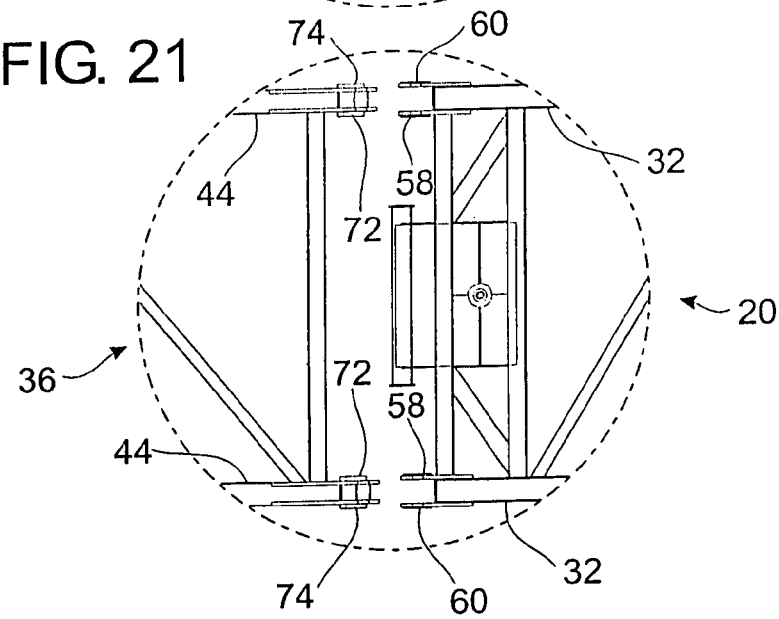

FIG. 19 shows a top view, FIG. 20 shows a side view and FIG. 21 shows a bottom view of the bottom mast section 20 juxtaposed with the top mast section 36 generally corresponding to the process steps shown illustrated in FIG. 3.

The mast stands 18 of the mast stand engage and raise the bottom mast section 20 so that the hooks 52 and 54 on the front legs 30 of the bottom mast stand engage the protruding circular plates 64 and 66 of the top mast section 36. The opening of the hooks is larger than the diameter of the circular plates so that they are guided into proper position.

Initially, the front legs of the bottom mast will be engaged with the front legs of the bottom mast section with the rear legs unengaged, as best shown in FIG. 20. As the bottom mast continues to be raised by the mast stands in the direction shown by arrow 84, the front legs will be brought in alignment and the rear legs will also thereafter be brought into alignment. It will, thus, be appreciated that raising of the bottom section will move the bottom section both vertically and radially.

Figure 22:
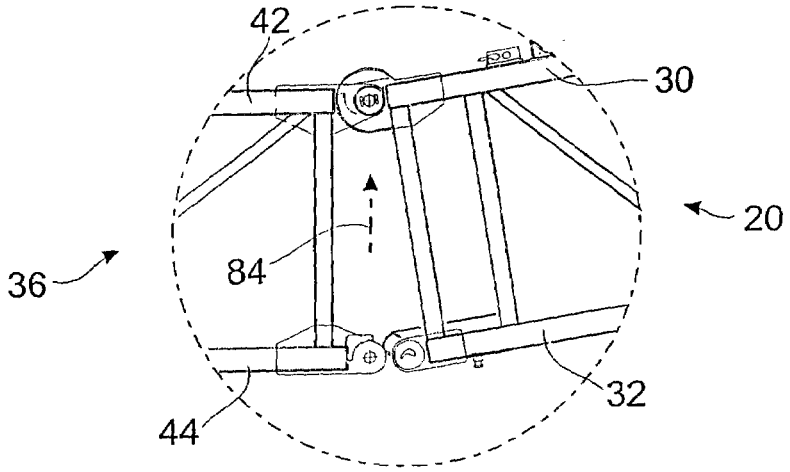
Figure 23:
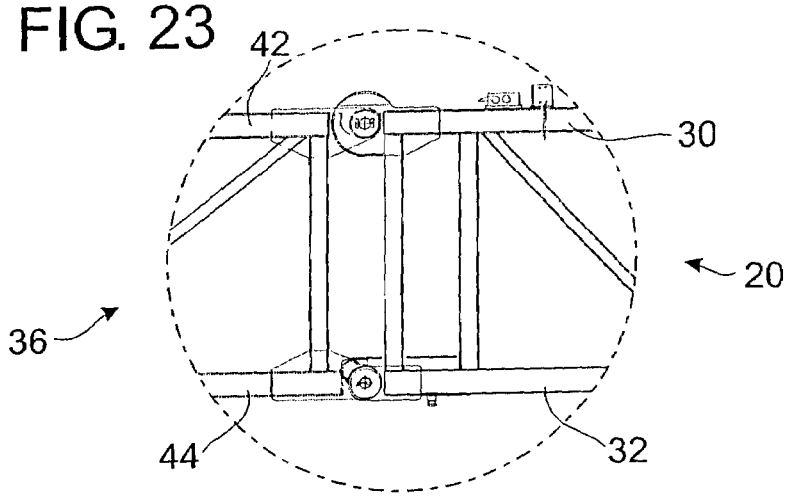
Figure 24:
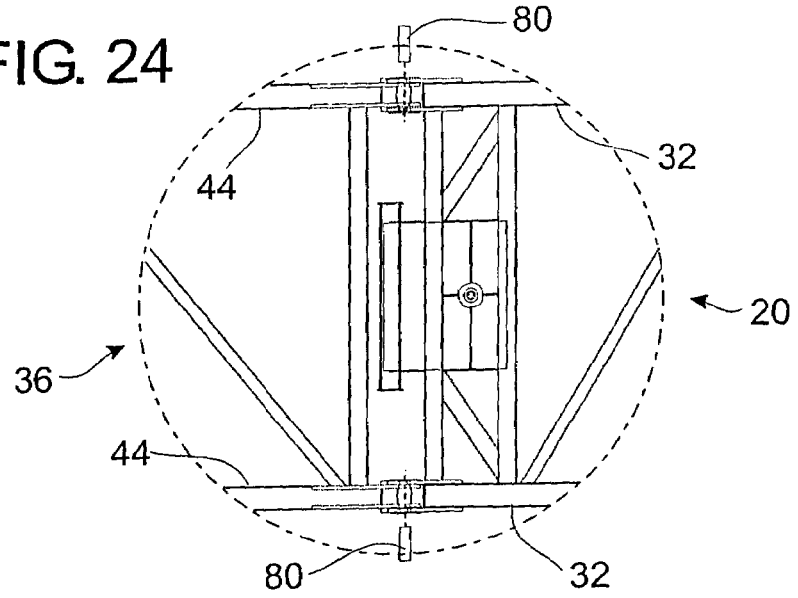

FIG. 22 shows the next sequence in the process as the bottom section 20 continues to be raised in the direction shown by arrow 84. The front legs are fully engaged thereby also raising the top mast section. Finally, as shown in the side view in FIG. 23 and the bottom view in FIG. 24, the mast sections are fully engaged and aligned. Once in the fully aligned position, pins 78 and 80 may easily be inserted through the openings to rigidly attach the bottom mast section to the top mast section.

Whereas, the present invention has been described in relation to the drawings attached hereto, it should be understood that other and further modifications, apart from those shown or suggested herein, may be made within the spirit and scope of this invention.

What is claimed is:

1. A method of self-aligning connections for a two section mast, which method comprises:

transporting an elongated bottom mast section to a guide frame adjacent to a well site, said bottom mast section having a pair of front legs and a pair of rear legs so that said bottom mast section is in a substantially horizontal orientation;

thereafter transporting an elongated top mast section to said well site so that said top mast section is in a substantially horizontal orientation and so that said mast sections are substantially aligned lengthwise, said top mast section having a pair of front legs and a pair of rear legs;

positioning said legs of said bottom mast section slightly below a level of said legs of said top mast section;

raising said bottom mast section; and simultaneously engaging and guiding the mast sections together in a final connecting orientation.

2. A method of self-aligning connections as set forth in claim 1 wherein said bottom mast section is raised by cylinders on mast stands.

3. A method of self-aligning connections as set forth in claim 2 wherein said cylinders are powered by a rig hydraulic system.

4. A method of self-aligning connections as set forth in claim 1 wherein said legs of said bottom mast section are positioned slightly below a level of said legs of said top mast section by lowering said bottom mast section before said raising step.

5. A method of self-aligning connections as set forth in claim 1 including the additional step of pinning said top mast section to said bottom mast section.

6. A method of self-aligning connections as set forth in claim 1 wherein said bottom mast section and said top mast section are each transported on a vehicle in a horizontal orientation prior to a vertical use orientation.

7. A method of self-aligning connections as set forth in claim 1 wherein said legs of said bottom mast section are positioned by cylinders on said mast stands.

8. A method of self-aligning connections as set forth in claim 1 wherein said pair of top mast front legs each include a pair of protruding circular plates which engage and align with said pair of bottom mast front legs which each include an alignment jaw with a pair of hooks.

9. A method of self-aligning connections as set forth in claim 1 wherein said pair of top mast rear legs each include a jaw with a shoulder which engage and align with said pair of bottom mast rear legs which each include a jaw with protruding semi-circular plates.

10. A method of self-aligning connections as set forth in claim 9 wherein each said shoulder includes a radial face to receive said circular plates.

11. A method of self-aligning connections as set forth in claim 1 wherein said steps are performed in reverse order to disassemble said two section mast.

12. A two section mast with self-aligning connections, which mast comprises:

an elongated bottom mast section having a pair of front legs and a pair of rear legs arranged in a substantially horizontal arrangement;

an elongated top mast section having a pair of front legs and a pair of rear legs arranged in a substantially horizontal arrangement wherein said mast sections are substantially aligned lengthwise;

means to simultaneously engage and guide the mast sections together including a self-aligning connection between said mast sections wherein said pair of top mast front legs each include a pair of protruding circular plates, each said pair of plates engage and align with a jaw with a pair of hooks extending from each said bottom mast front leg and wherein said pair of top mast rear legs each include a jaw with a shoulder, each said jaw engaging and aligning with a jaw with protruding semi-circular plates extending from each bottom mast rear leg; and at least one hydraulic cylinder on a mast stand to move said legs of said bottom section from a position slightly below a level of said legs of said top mast section to an engaged position in which the mast sections are in a final connecting orientation.

13. A two section mast as set forth in claim 12 including a pin passing through each said jaw of said bottom mast front legs and through each said pair of protruding circular plates of said top mast front legs.

14. A two section mast as set forth in claim 12 including a pin passing through each said jaw with a shoulder of said top mast rear legs and through each said jaw with protruding semi-circular plates of said bottom mast rear legs.

* * * * *